US005382491A

United States Patent [19]

Diaz et al.

[11] Patent Number: 5,382,491

[45] Date of Patent: Jan. 17, 1995

[54] TONER COMPOSITION

[75] Inventors: Arthur F. Diaz, San Jose, Calif.; Jean M. Guay, Boulder, Colo.; My T. Nguyen, San Jose, Calif.

[73] Assignee: International Business Machines Corporation, Armonk, N.Y.

[21] Appl. No.: 172,682

[22] Filed: Dec. 21, 1993

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 3,963,498 | 6/1976 | Trevoy | 428/411 |
| 4,237,194 | 12/1980 | Upson et al. | 428/424.2 |
| 4,308,332 | 12/1981 | Upson et al. | 430/62 |
| 4,526,706 | 7/1985 | Upson et al. | 252/500 |
| 4,855,361 | 8/1989 | Yaniger et al. | 525/436 |
| 5,109,070 | 4/1992 | Epstein et al. | 525/189 |
| 5,137,991 | 8/1992 | Epstein et al. | 525/540 |
| 5,164,465 | 11/1992 | Epstein et al. | 525/540 |

FOREIGN PATENT DOCUMENTS

| | | | |
|---|---|---|---|
| 497514 | 1/1992 | European Pat. Off. | H01B 1/20 |
| 171060 | 10/1983 | Japan | 430/110 |
| 131544 | 7/1985 | Japan | 430/110 |
| 2120865 | 5/1990 | Japan . | |
| 4056865 | 2/1992 | Japan . | |

*Primary Examiner*—Roland Martin
*Attorney, Agent, or Firm*—Robert B. Martin

[57] ABSTRACT

The present invention relates to an improved toner composition for electrophotography comprising an improved polyaniline charge control agent.

7 Claims, No Drawings

TONER COMPOSITION

FIELD OF THE INVENTION

The present invention relates to an toner composition for use in electrophotography comprising an improved charge control agent.

BACKGROUND OF THE INVENTION

In electrophotography an image comprising an electrostatic field pattern, usually of non-uniform strength, (also referred to as an electrostatic latent image) is formed on an insulative surface of an electrophotographic element. The insulative surface comprises a photoconductive layer and an electrically conductive substrate. The electrostatic latent image may be formed by imagewise photo-induced dissipation of the strength of portions of an electrostatic field of uniform strength previously formed on the insulative surface. Typically, the electrostatic latent image is then developed into a toner image by contacting the latent image with a toner composition generally containing a pigment. The toner image is then transferred onto a transfer medium such as paper and fixed thereon by heating and/or pressure. The last step involves cleaning residual toner from the electrophotographic element.

Dry toner compositions used in electrophotography are divided into one-component compositions composed of a toner generally comprising a binder resin having a colorant dispersed therein and two-component compositions composed of a toner and a carrier. Charge control agents are generally melt mixed with the toner resin to control the level and range or distribution of charge of the toner during use. The desired level of chargeability is dependent on the method of development and development hardware. Charge control agents are often selected to achieve the desired charge level. High positive charge levels are often desired in electrophotography. It is also desired to have a narrow range of charge on the toner particles to avoid wrong sign toner particles and also to improve performance of the toner composition. Extraparticulate inorganic fine particles such as fumed silica are frequently added to toner compositions to improve fluidity and anti-caking properties.

Monomeric charge control agents are known in the art such as amines and quaternary ammonium salts for positive charge toners and metal complex dyes for negative charge toners. These charge control agents are generally blended into the melted toner resin which is then cooled and ground into fine particles. Unfortunately, monomeric charge control agents exhibit fast charge decay after prolonged use. Polymeric charge control agents do not exhibit this fast decay after prolonged use. It is therefore desired to utilize polymeric charge control agents in toner particles to improve charge stability.

Hitachi Japanese patent 2120865 dated May 8, 1990 discloses color toner beads comprising resin, conductive polyaniline and carbon black as a charge control agent. The carbon black is weakly charging and therefore the toner will have a low average positive charge and further, will have a broad range of charged particles making the toner susceptible to wrong sign toner particles. Therefore, there still is a need in the art for a suitable polymeric charge control agent for use in positively charged toner compositions.

It is therefore an object of the present invention to provide an improved toner composition comprising an improved polymeric charge control agent.

Other objects and advantages will become apparent from the following disclosure.

SUMMARY OF THE INVENTION

The present invention relates to an improved particulate toner composition for use in electrophotography comprising toner and base treated polyaniline which functions as a charge control agent. The base treated polyaniline is non-conductive. Optionally, the composition may also comprise a colorant, a carrier, inorganic fine particles and other additives known to those skilled in the art. Surprisingly, the base treated polyaniline provides the toner composition with a large average charge and also a narrow distribution of charge level on the individual toner particles to improve the performance of the toner composition.

A more thorough disclosure of the present invention is presented in the detail description which follows.

DETAILED DESCRIPTION OF THE INVENTION

The present invention relates to an improved particulate, dry toner composition for use in electrophotography comprising toner and base treated polyaniline. The key ingredient in the composition of the present invention is the based treated polyaniline. As used herein "base treated polyaniline" shall mean unsubstituted or substituted polyaniline which has been contacted with a base. The polyaniline for use in the present invention can be unsubstituted or optionally substituted with a variety of substituents which do not interfer with the charge control ability such as (i) N-substituted such as N-alkyl where alkyl is $C_1$–$C_{10}$ or N-phenyl or (ii) substituted on the aromatic ring with substituents such as $C_1$–$C_{10}$ alkyl, phenyl, halo, benzyl or $C_1$–$C_{10}$ alkylsiloxane.

The polyanilines will suitably have a molecular weight (Mn) of about 4000 to about 400,000.

Polyanilines are commercially available and also can be synthesized by art known procedures. The base used to treat the polyaniline suitably has a concentration of about 0.1 to about 8 molar, preferably about 0.1 to about 2 molar and pit of about 8 or greater, preferably greater than about 9, more preferably about 10. Very high pit may cause some degradation of the polyaniline. Preferably the base is a Bronsted base, preferably ammonium hydroxide or an alkaline base. The preferred base anion is hydroxy.

The polyaniline is conveniently suspended in water and contacted with the liquid base (base dissolved in a suitable solvent, preferably water) for a short period of time of about 10–300 minutes with stirring. The polyaniline is then removed from the liquid base by filtration or centrifugation, rinsed several times with suitable solvent such as water to remove base and dried in a vacuum oven at room temperature e.g. 20° C. The base-treated polyaniline is electrically non-conductive having a conductivity less than $1\times10^{8-}$seimens/cm, preferably less than $1\times10^{-10}$ seimens/cm.

A variety of toner particles known to those skilled in the art can be used in the toner composition of the present invention. Toner particles generally comprise a resin and optionally a colorant.

As a resin for the toner particles to be used in the present invention, there may be employed homopolymers of styrene and its derivatives and copolymers thereof such as polystyrene, poly-p-chorostyrene, polyvinyltoluene, styrene-p-chlorostyrene copolymer, styrene-vinyltoluene copolymer; copolymers of styrene and acrylic acid ester such as styrene-methyl acrylate copolymer, styrene-ethyl acrylate copolymer, styrene-n-butyl acrylate copolymer, styrene-2-ethylhexyl acrylate copolymer; copolymers of styrene and methacrylic acid ester such as styrene-methyl methacrylate, styrene-ethyl methacrylate, styrene-n-butyl methacrylate, styrene-2-ethylhexyl methacrylate; multi-component copolymers of styrene, acrylic acid ester and methacrylic acid ester; styrene copolymers of styrene with other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene-maleic acid ester copolymer; polymethyl methacrylate, polybutyl methacrylate, polyvinyl acetate, polyester, epoxy resin, polyvinyl butyral, polyacrylic acid resin, phenolic resin, aliphatic or alicyclic hydrocarbon resin, petroleum resin, chlorine paraffin, either individually or as a mixture.

Suitable resins for the toner particles for use with pressure fixing electrophotography, are low molecular weight polyethylene, low molecular weight polypropylene, ethylene-vinyl acetate copolymer, ethylene-acrylic acid ester copolymer, higher fatty acid and polyester resin. Other types of suitable resins for toner particles in the composition of the present invention will be known to those skilled in the art.

Optional colorants for the toner particles include a pigment or a dye as the colorant. For example, carbon black, solvent black, phthalocyanine blue, Ultramarine, quinacridone, benzidine yellow may be utilized.

The resin, base-treated polyaniline and colorant components of the toner can be conveniently melt mixed together such as by melt-blending the components in a mixer such as a Rheomix twin screw mixer. The solidified melt is ground to desired size (size classified) to form a free-flowing powder of toner particles. Alternatively, the toner components can be solution blended in a volatile solvent such as dichloromethane and then atomized in a spray dryer to produce toner particles, as is well known. Alternatively, the base-treated polyaniline can be added with an extraparticulate as a flowing agent.

Toner particles may have an average diameter between about 0.5 microns (μm) and about 50 μm, a value in the range from about 8.0 to about 20 μm being preferable for many currently used machines. However, larger or smaller particles may be needed for particular methods of development or development conditions.

If desired, the toner of the present invention may further contain known additives such as release agents.

The toner composition of the present invention will generally comprise about 90 to about 99.9 weight % of the toner and about 0.1 to about 10 weight of the base-treated polyaniline preferably about 3 to 6 weight % of base-treated polyaniline.

The toner particles of the invention may be used alone in monocomponent developers or may be mixed with a suitable carrier vehicle known to those skilled in the art for use in dual component developers. The carrier vehicles which can be used to form developer compositions can be selected from various materials. Such materials include carrier core particles and core particles overcoated with a thin layer of film-forming resin to establish the correct triboelectric relationship and charge level with the toner employed. Suitable carriers for two component toner compositions include iron powder, glass beads, crystals of inorganic salts, ferrite powder, nickel powder an these powders having thereon a resin coating such as epoxy or fluorocarbon resins.

The toner composition of the present invention may also contain other known additives such as waxes and siloxane oils.

The toner composition with extraparticulates can be made by admixing the components (toner and extraparticulates) together in a blender.

The following examples are detailed descriptions of compositions of the present invention. The descriptions fall within the scope of, and serve to exemplify, the more generally described compositions set forth above. The examples are presented for illustrative purposes only, and are not intended as a restriction on the scope of the invention.

Charging Experiments

I. Components

1. Toner—poly(styrene-co-butylmethacrylate).
2. Polyaniline—polyaniline.
3. Base-treated polyaniline is polyaniline which has been contacted with 1.0 molar ammonium hydroxide (pH=10) for period of 5 hours, then dried and ground into particles <40 nanometers.
4. Toner Composition is dual component comprising (i) 97.5 weight % of 140 micron steel carrier beads and (ii) 2.5 weight % of toner which comprises 6 weight % polyaniline and 94 weight % poly(styrene-co-butylmethacrylate)

II. Test Procedure

The toner composition was rolled in a metal can for indicated period of time. Aliquots of the composition were then transferred to a Faraday cage, known as a blow-off cage, and the toner was blown away from the carrier and out of the cage using forced air. The charge on the toner was obtained from the charge (Q) an weight (M) change of the cage and was reported as Q/M

| | TONER CHARGE (uc/g) | | |
|---|---|---|---|
| Rolling Time (min) | Toner | Toner + Polyaniline | Toner + base treated polyaniline |
| 0 | 0 | −4 | +3 |
| 5 | −3 | −9 | +5 |
| 10 | −7 | −13 | +7 |
| 30 | −21 | −18 | +13 |
| 60 | −37 | −23 | +16 |
| 120 | −44 | −31 | +20 |
| 180 | −38 | −37 | +21 |

| | TONER CHARGE (uc/g) |
|---|---|
| Rolling Time Minutes | Toner + base treated N-ethyl polyaniline |
| 0 | 15 |
| 5 | 20 |
| 10 | 22 |
| 30 | 26 |
| 60 | 27 |
| 90 | 27 |
| 120 | 28 |

-continued

| TONER CHARGE (uc/g) | |
|---|---|
| Rolling Time Minutes | Toner + base treated N-ethyl polyaniline |
| 180 | 27 |

The results of the test suprisingly show that the base treated polyanilines of the present invention provide substantially greater positive charge control than conductive polyaniline. The greater positive charge control provides the toner composition with a large average positive charge which improves the performance of the toner composition.

Although this invention has been described with respect to specific embodiments, the details thereof are not to be construed as limitations for it will be apparent that various embodiments, changes, and modifications may be resorted to without departing from the spirit and scope thereof, and it is understood that such equivalent embodiments are intended to be included within the scope of this invention.

We claim:

1. A toner composition for use in electrophotography comprising toner and a nonconductive base treated polyaniline.

2. The composition of claim 1 wherein said base treated polyaniline is treated with a base having a pH of 8 or greater.

3. The composition of claim 1 wherein said toner is poly(styrene-co-methacrylate).

4. The composition of claim 1 wherein said toner is poly(styrene-co-acrylate).

5. The composition of claim 1 wherein said toner contains a colorant.

6. The composition of claim 1 further comprising an inorganic dispersing agent.

7. The composition of claim 1 further comprising a carrier.

* * * * *